US009761158B2

(12) United States Patent
Ouchi

(10) Patent No.: US 9,761,158 B2
(45) Date of Patent: Sep. 12, 2017

(54) IMAGE PROCESSING APPARATUS, IMAGE PROCESSING METHOD, AND STORAGE MEDIUM

(71) Applicant: CANON KABUSHIKI KAISHA, Tokyo (JP)

(72) Inventor: Akihiro Ouchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/557,625

(22) Filed: Dec. 2, 2014

(65) Prior Publication Data

US 2015/0170559 A1 Jun. 18, 2015

(30) Foreign Application Priority Data

Dec. 18, 2013 (JP) ..... 2013-261833

(51) Int. Cl.
*G09G 3/00* (2006.01)

(52) U.S. Cl.
CPC ..... *G09G 3/002* (2013.01); *G09G 2320/0233* (2013.01)

(58) Field of Classification Search
CPC ..... G09G 2320/0233; G09G 3/002
USPC ..... 345/1.2, 1.3, 690, 4, 600
See application file for complete search history.

(56) References Cited

U.S. PATENT DOCUMENTS 5,475,447 A * 12/1995 Funado ..... H04N 3/2335 348/745
6,222,593 B1 * 4/2001 Higurashi ..... G03B 37/04 315/368.12
6,456,339 B1 * 9/2002 Surati ..... G03B 37/04 348/744
6,552,705 B1 * 4/2003 Hirota ..... G09G 3/3648 345/103
6,570,623 B1 * 5/2003 Li ..... H04N 9/3194 348/383
6,733,138 B2 * 5/2004 Raskar ..... H04N 9/12 345/32

(Continued)

FOREIGN PATENT DOCUMENTS

JP 2006-243200 A 9/2006
JP 2007-206356 A 8/2007

*Primary Examiner* — Tony Davis
(74) *Attorney, Agent, or Firm* — Fitzpatrick, Cella, Harper & Scinto

(57) ABSTRACT

An image processing apparatus comprises a specification unit configured to, from a multi-screen display corresponding to multi-screen displays performed by a plurality of projection apparatuses, specify an overlapping region in which first and second projection regions for first and second projection apparatuses overlap; a determination unit configured to, based on the positions of the overlapping regions in the first and second projection regions, determine luminance correction coefficients corresponding to the overlapping region such that the luminance correction coefficient at a coordinate corresponding to a first vertex in the overlapping region and a luminance correction coefficient at a coordinate corresponding to a second vertex located diagonally opposite to the first vertex in the overlapping region are different; and a correction unit configured to correct luminance of image data for the multi-screen display, based on the determined correction coefficients.

18 Claims, 14 Drawing Sheets

(56) References Cited

U.S. PATENT DOCUMENTS 6,755,537 B1 * 6/2004 Raskar ..... H04N 5/74 348/383
6,760,075 B2 * 7/2004 Mayer, III ..... H04N 9/12 345/1.3
6,804,406 B1 * 10/2004 Chen ..... G06T 3/4038 345/1.3
7,114,813 B2 * 10/2006 Wada ..... H04N 5/74 348/745
7,215,362 B2 * 5/2007 Klose ..... H04N 9/3147 345/1.1
2001/0022651 A1 * 9/2001 Kubota et al. ..... 353/94
2002/0008675 A1 * 1/2002 Mayer, III ..... G06F 3/1446 345/4
2003/0128337 A1 * 7/2003 Jaynes ..... G03B 21/26 353/30
2004/0085256 A1 * 5/2004 Hereld ..... H04N 9/12 345/1.1
2004/0085477 A1 * 5/2004 Majumder ..... H04N 9/12 348/383
2004/0140981 A1 * 7/2004 Clark ..... H04N 9/3182 345/600
2004/0155965 A1 * 8/2004 Jaynes ..... H04N 5/74 348/189
2004/0239884 A1 * 12/2004 Nagashima ..... H04N 9/12 353/30
2005/0140568 A1 * 6/2005 Inazumi ..... 345/1.3
2005/0206857 A1 * 9/2005 Yamada ..... G03B 21/56 353/94
2005/0271299 A1 * 12/2005 Ajito ..... G06T 3/005 382/293
2006/0012759 A1 * 1/2006 Matsushita ..... 353/94
2006/0146295 A1 * 7/2006 Harboe ..... H04N 9/3147 353/94
2006/0192925 A1 * 8/2006 Chang ..... G03B 37/04 353/94
2007/0171380 A1 * 7/2007 Wright et al. ..... 353/69
2007/0273837 A1 * 11/2007 Furui ..... G03B 37/00 353/31
2012/0105414 A1 * 5/2012 Yu ..... G09G 3/3674 345/211
2012/0262660 A1 * 10/2012 Fujiwara ..... G02F 1/1333 349/158
2013/0113683 A1 * 5/2013 Kitajima ..... 345/1.2
2014/0168283 A1 * 6/2014 Ouchi ..... 345/690

* cited by examiner

FIG. 2

A" A (0,0) (8,0)

B' A'

| | | | | | | | | |
|---|---|---|---|---|---|---|---|---|
| 1.000 | 1.000 | 1.000 | 1.000 | 1.000 | 1.000 | 1.000 | 1.000 | 1.000 |
| 0.875 | 0.875 | 0.875 | 0.875 | 0.875 | 0.875 | 0.875 | 0.875 | 1.000 |
| 0.750 | 0.750 | 0.750 | 0.750 | 0.750 | 0.750 | 0.750 | 0.857 | 1.000 |
| 0.625 | 0.625 | 0.625 | 0.625 | 0.625 | 0.625 | 0.714 | 0.833 | 1.000 |
| 0.500 | 0.500 | 0.500 | 0.500 | 0.500 | 0.571 | 0.667 | 0.800 | 1.000 |
| 0.375 | 0.375 | 0.375 | 0.375 | 0.429 | 0.500 | 0.600 | 0.750 | 1.000 |
| 0.250 | 0.250 | 0.250 | 0.286 | 0.333 | 0.400 | 0.500 | 0.667 | 1.000 |
| 0.125 | 0.125 | 0.143 | 0.167 | 0.200 | 0.250 | 0.333 | 0.500 | 1.000 |
| 0.000 | 0.000 | 0.000 | 0.000 | 0.000 | 0.000 | 0.000 | 0.000 | 0.000 |

(0,8) (8,8)

B B"

T100

| | | | | | | | | |
|---|---|---|---|---|---|---|---|---|
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |
| 1.000 | 0.875 | 0.750 | 0.625 | 0.500 | 0.375 | 0.250 | 0.125 | 0.000 |

A B

T110

| | | | | | | | | |
|---|---|---|---|---|---|---|---|---|
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |
| 0.000 | 0.125 | 0.250 | 0.375 | 0.500 | 0.625 | 0.750 | 0.875 | 1.000 |

B A

T101

| | A | | | | | | | | |
|---|---|---|---|---|---|---|---|---|---|
| A | 1.000 | 1.000 | 1.000 | 1.000 | 1.000 | 1.000 | 1.000 | 1.000 | 1.000 |
| | 1.000 | 0.875 | 0.875 | 0.875 | 0.875 | 0.875 | 0.875 | 0.875 | 0.875 |
| | 1.000 | 0.857 | 0.750 | 0.750 | 0.750 | 0.750 | 0.750 | 0.750 | 0.750 |
| | 1.000 | 0.833 | 0.714 | 0.625 | 0.625 | 0.625 | 0.625 | 0.625 | 0.625 |
| | 1.000 | 0.800 | 0.667 | 0.571 | 0.500 | 0.500 | 0.500 | 0.500 | 0.500 |
| | 1.000 | 0.750 | 0.600 | 0.500 | 0.429 | 0.375 | 0.375 | 0.375 | 0.375 |
| | 1.000 | 0.667 | 0.500 | 0.400 | 0.333 | 0.286 | 0.250 | 0.250 | 0.250 |
| | 1.000 | 0.500 | 0.333 | 0.250 | 0.200 | 0.167 | 0.143 | 0.125 | 0.125 |
| A' | 0.000 | 0.000 | 0.000 | 0.000 | 0.000 | 0.000 | 0.000 | 0.000 | 0.000 |
| | B" | | | | | | | | B |

T120

| | B | | | | | | | | |
|---|---|---|---|---|---|---|---|---|---|
| B | 0.000 | 0.000 | 0.000 | 0.000 | 0.000 | 0.000 | 0.000 | 0.000 | 0.000 |
| | 0.000 | 0.125 | 0.125 | 0.125 | 0.125 | 0.125 | 0.125 | 0.125 | 0.125 |
| | 0.000 | 0.143 | 0.250 | 0.250 | 0.250 | 0.250 | 0.250 | 0.250 | 0.250 |
| | 0.000 | 0.167 | 0.286 | 0.375 | 0.375 | 0.375 | 0.375 | 0.375 | 0.375 |
| | 0.000 | 0.200 | 0.333 | 0.429 | 0.500 | 0.500 | 0.500 | 0.500 | 0.500 |
| | 0.000 | 0.250 | 0.400 | 0.500 | 0.571 | 0.625 | 0.625 | 0.625 | 0.625 |
| | 0.000 | 0.333 | 0.500 | 0.600 | 0.667 | 0.714 | 0.750 | 0.750 | 0.750 |
| | 0.000 | 0.500 | 0.667 | 0.750 | 0.800 | 0.833 | 0.857 | 0.875 | 0.875 |
| B' | 1.000 | 1.000 | 1.000 | 1.000 | 1.000 | 1.000 | 1.000 | 1.000 | 1.000 |
| | A" | | | | | | | | A |

T111

| | | | | | | | | |
|---|---|---|---|---|---|---|---|---|
| 1.000 | 1.000 | 1.000 | 1.000 | 1.000 | 1.000 | 1.000 | 1.000 | 1.000 |
| 0.875 | 0.875 | 0.875 | 0.875 | 0.875 | 0.875 | 0.875 | 0.875 | 1.000 |
| 0.750 | 0.750 | 0.750 | 0.750 | 0.750 | 0.750 | 0.750 | 0.857 | 1.000 |
| 0.625 | 0.625 | 0.625 | 0.625 | 0.625 | 0.625 | 0.714 | 0.833 | 1.000 |
| 0.500 | 0.500 | 0.500 | 0.500 | 0.500 | 0.571 | 0.667 | 0.800 | 1.000 |
| 0.375 | 0.375 | 0.375 | 0.375 | 0.429 | 0.500 | 0.600 | 0.750 | 1.000 |
| 0.250 | 0.250 | 0.250 | 0.286 | 0.333 | 0.400 | 0.500 | 0.667 | 1.000 |
| 0.125 | 0.125 | 0.143 | 0.167 | 0.200 | 0.250 | 0.333 | 0.500 | 1.000 |
| 0.000 | 0.000 | 0.000 | 0.000 | 0.000 | 0.000 | 0.000 | 0.000 | 0.000 |

T121

| | | | | | | | | |
|---|---|---|---|---|---|---|---|---|
| 0.000 | 0.000 | 0.000 | 0.000 | 0.000 | 0.000 | 0.000 | 0.000 | 0.000 |
| 0.125 | 0.125 | 0.125 | 0.125 | 0.125 | 0.125 | 0.125 | 0.125 | 0.000 |
| 0.250 | 0.250 | 0.250 | 0.250 | 0.250 | 0.250 | 0.250 | 0.143 | 0.000 |
| 0.375 | 0.375 | 0.375 | 0.375 | 0.375 | 0.375 | 0.286 | 0.167 | 0.000 |
| 0.500 | 0.500 | 0.500 | 0.500 | 0.500 | 0.429 | 0.333 | 0.200 | 0.000 |
| 0.625 | 0.625 | 0.625 | 0.625 | 0.571 | 0.500 | 0.400 | 0.250 | 0.000 |
| 0.750 | 0.750 | 0.750 | 0.714 | 0.667 | 0.600 | 0.500 | 0.333 | 0.000 |
| 0.875 | 0.875 | 0.857 | 0.833 | 0.800 | 0.750 | 0.667 | 0.500 | 0.000 |
| 1.000 | 1.000 | 1.000 | 1.000 | 1.000 | 1.000 | 1.000 | 1.000 | 1.000 |

| | | | | | | | | |
|---|---|---|---|---|---|---|---|---|
| 1.000 | 0.875 | 0.750 | 0.625 | 0.500 | 0.375 | 0.250 | 0.125 | 0.000 |
| 0.875 | 0.766 | 0.656 | 0.547 | 0.438 | 0.328 | 0.219 | 0.109 | 0.000 |
| 0.750 | 0.656 | 0.563 | 0.469 | 0.375 | 0.281 | 0.188 | 0.094 | 0.000 |
| 0.625 | 0.547 | 0.469 | 0.391 | 0.313 | 0.234 | 0.156 | 0.078 | 0.000 |
| 0.500 | 0.438 | 0.375 | 0.313 | 0.250 | 0.188 | 0.125 | 0.063 | 0.000 |
| 0.375 | 0.328 | 0.281 | 0.234 | 0.188 | 0.141 | 0.094 | 0.047 | 0.000 |
| 0.250 | 0.219 | 0.188 | 0.156 | 0.125 | 0.094 | 0.063 | 0.031 | 0.000 |
| 0.125 | 0.109 | 0.094 | 0.078 | 0.063 | 0.047 | 0.031 | 0.016 | 0.000 |
| 0.000 | 0.000 | 0.000 | 0.000 | 0.000 | 0.000 | 0.000 | 0.000 | 0.000 |

| | | | | | | | | |
|---|---|---|---|---|---|---|---|---|
| 0.000 | 0.125 | 0.250 | 0.375 | 0.500 | 0.625 | 0.750 | 0.875 | 1.000 |
| 0.000 | 0.109 | 0.219 | 0.328 | 0.438 | 0.547 | 0.656 | 0.766 | 0.875 |
| 0.000 | 0.094 | 0.188 | 0.281 | 0.375 | 0.469 | 0.563 | 0.656 | 0.750 |
| 0.000 | 0.078 | 0.156 | 0.234 | 0.313 | 0.391 | 0.469 | 0.547 | 0.625 |
| 0.000 | 0.063 | 0.125 | 0.188 | 0.250 | 0.313 | 0.375 | 0.438 | 0.500 |
| 0.000 | 0.047 | 0.094 | 0.141 | 0.188 | 0.234 | 0.281 | 0.328 | 0.375 |
| 0.000 | 0.031 | 0.063 | 0.094 | 0.125 | 0.156 | 0.188 | 0.219 | 0.250 |
| 0.000 | 0.016 | 0.031 | 0.047 | 0.063 | 0.078 | 0.094 | 0.109 | 0.125 |
| 0.000 | 0.000 | 0.000 | 0.000 | 0.000 | 0.000 | 0.000 | 0.000 | 0.000 |

| | | | | | | | | |
|---|---|---|---|---|---|---|---|---|
| 0.000 | 0.000 | 0.000 | 0.000 | 0.000 | 0.000 | 0.000 | 0.000 | 0.000 |
| 0.125 | 0.125 | 0.125 | 0.125 | 0.125 | 0.125 | 0.125 | 0.125 | 0.125 |
| 0.250 | 0.250 | 0.250 | 0.250 | 0.250 | 0.250 | 0.250 | 0.250 | 0.250 |
| 0.375 | 0.375 | 0.375 | 0.375 | 0.375 | 0.375 | 0.375 | 0.375 | 0.375 |
| 0.500 | 0.500 | 0.500 | 0.500 | 0.500 | 0.500 | 0.500 | 0.500 | 0.500 |
| 0.625 | 0.625 | 0.625 | 0.625 | 0.625 | 0.625 | 0.625 | 0.625 | 0.625 |
| 0.750 | 0.750 | 0.750 | 0.750 | 0.750 | 0.750 | 0.750 | 0.750 | 0.750 |
| 0.875 | 0.875 | 0.875 | 0.875 | 0.875 | 0.875 | 0.875 | 0.875 | 0.875 |
| 1.000 | 1.000 | 1.000 | 1.000 | 1.000 | 1.000 | 1.000 | 1.000 | 1.000 |

T200

| | | | | | | | | |
|---|---|---|---|---|---|---|---|---|
| 1.000 | 1.000 | 1.000 | 1.000 | 1.000 | 1.000 | 1.000 | 1.000 | 1.000 |
| 0.000 | 0.500 | 0.667 | 0.750 | 0.800 | 0.833 | 0.857 | 0.875 | 1.000 |
| 0.000 | 0.333 | 0.500 | 0.600 | 0.667 | 0.714 | 0.750 | 0.857 | 1.000 |
| 0.000 | 0.250 | 0.400 | 0.500 | 0.571 | 0.625 | 0.714 | 0.833 | 1.000 |
| 0.000 | 0.200 | 0.333 | 0.429 | 0.500 | 0.571 | 0.667 | 0.800 | 1.000 |
| 0.000 | 0.167 | 0.286 | 0.375 | 0.429 | 0.500 | 0.600 | 0.750 | 1.000 |
| 0.000 | 0.143 | 0.250 | 0.286 | 0.333 | 0.400 | 0.500 | 0.667 | 1.000 |
| 0.000 | 0.125 | 0.143 | 0.167 | 0.200 | 0.250 | 0.333 | 0.500 | 1.000 |
| 0.000 | 0.000 | 0.000 | 0.000 | 0.000 | 0.000 | 0.000 | 0.000 | 0.000 |

T210

| | | | | | | | | |
|---|---|---|---|---|---|---|---|---|
| 0.000 | 0.000 | 0.000 | 0.000 | 0.000 | 0.000 | 0.000 | 0.000 | 0.000 |
| 1.000 | 0.500 | 0.333 | 0.250 | 0.200 | 0.167 | 0.143 | 0.125 | 0.000 |
| 1.000 | 0.667 | 0.500 | 0.400 | 0.333 | 0.286 | 0.250 | 0.143 | 0.000 |
| 1.000 | 0.750 | 0.600 | 0.500 | 0.429 | 0.375 | 0.286 | 0.167 | 0.000 |
| 1.000 | 0.800 | 0.667 | 0.571 | 0.500 | 0.429 | 0.333 | 0.200 | 0.000 |
| 1.000 | 0.833 | 0.714 | 0.625 | 0.571 | 0.500 | 0.400 | 0.250 | 0.000 |
| 1.000 | 0.857 | 0.750 | 0.714 | 0.667 | 0.600 | 0.500 | 0.333 | 0.000 |
| 1.000 | 0.875 | 0.857 | 0.833 | 0.800 | 0.750 | 0.667 | 0.500 | 0.000 |
| 1.000 | 1.000 | 1.000 | 1.000 | 1.000 | 1.000 | 1.000 | 1.000 | 1.000 |

| | | | | | | | | |
|---|---|---|---|---|---|---|---|---|
| 1.000 | 1.000 | 1.000 | 1.000 | 1.000 | 1.000 | 1.000 | 1.000 | 1.000 |
| 0.875 | 0.875 | 0.875 | 0.875 | 0.875 | 0.875 | 0.875 | 0.875 | 0.875 |
| 0.750 | 0.750 | 0.750 | 0.750 | 0.750 | 0.750 | 0.750 | 0.750 | 0.750 |
| 0.625 | 0.625 | 0.625 | 0.625 | 0.625 | 0.625 | 0.625 | 0.625 | 0.625 |
| 0.500 | 0.500 | 0.500 | 0.500 | 0.500 | 0.500 | 0.500 | 0.500 | 0.500 |
| 0.375 | 0.375 | 0.375 | 0.375 | 0.375 | 0.375 | 0.375 | 0.375 | 0.375 |
| 0.250 | 0.250 | 0.250 | 0.250 | 0.250 | 0.250 | 0.250 | 0.250 | 0.250 |
| 0.125 | 0.125 | 0.125 | 0.125 | 0.125 | 0.125 | 0.125 | 0.125 | 0.125 |
| 0.000 | 0.000 | 0.000 | 0.000 | 0.000 | 0.000 | 0.000 | 0.000 | 0.000 |

| | | | | | | | | |
|---|---|---|---|---|---|---|---|---|
| 0.000 | 0.000 | 0.000 | 0.000 | 0.000 | 0.000 | 0.000 | 0.000 | 0.000 |
| 0.125 | 0.125 | 0.125 | 0.125 | 0.125 | 0.125 | 0.125 | 0.125 | 0.125 |
| 0.250 | 0.250 | 0.250 | 0.250 | 0.250 | 0.250 | 0.250 | 0.250 | 0.250 |
| 0.375 | 0.375 | 0.375 | 0.375 | 0.375 | 0.375 | 0.375 | 0.375 | 0.375 |
| 0.500 | 0.500 | 0.500 | 0.500 | 0.500 | 0.500 | 0.500 | 0.500 | 0.500 |
| 0.625 | 0.625 | 0.625 | 0.625 | 0.625 | 0.625 | 0.625 | 0.625 | 0.625 |
| 0.750 | 0.750 | 0.750 | 0.750 | 0.750 | 0.750 | 0.750 | 0.750 | 0.750 |
| 0.875 | 0.875 | 0.875 | 0.875 | 0.875 | 0.875 | 0.875 | 0.875 | 0.875 |
| 1.000 | 1.000 | 1.000 | 1.000 | 1.000 | 1.000 | 1.000 | 1.000 | 1.000 |

IMAGE PROCESSING APPARATUS, IMAGE PROCESSING METHOD, AND STORAGE MEDIUM

BACKGROUND OF THE INVENTION

Field of the Invention

The present invention relates to an image processing apparatus, an image processing method, and a storage medium.

Description of the Related Art

Conventionally, when multi-screen display is to be configured using multiple projection-type image display apparatuses, an image overlapping region in which adjacent projected images overlap is provided, and uniformity in the overall luminance is realized by performing luminance correction on the image signal for the image overlapping region (so-called edge blending). Note that setting the image overlapping region at an arbitrary width has an effect of making it difficult to view even if display characteristics such as luminance and hue differ only slightly for each projection-type image display apparatus.

When multi-screen display is to be configured, it is generally configured using projection-type image display apparatuses with the same screen size such that it has an overall rectangular shape. Japanese Patent Laid-Open No. 2006-243200 discloses a method for configuring multi-screen display with a free layout. Also, Japanese Patent Laid-Open No. 2007-206356 discloses a system for configuring a rectangular multi-screen display using projection-type image display apparatuses of different screen sizes.

In general, the edge-blending function included in projection-type image display apparatuses that are currently commercially available is provided as a function of setting one overlapping region on each of the four sides of a screen.

For example, overlapping regions that can be set in the case where three screens are laid out in a "T shape" are, as shown in FIG. 8A, an overlapping region B500 in a screen IMG500, an overlapping region B510 in a screen IMG510, and an overlapping region B520 in a screen IMG520. In this case, a multi-screen display IMG530 will end up being a screen in which the luminance of an overlapping region G520 is high. Alternatively, as shown in FIG. 8B, it is also conceivable to further set an overlapping region B501 in the screen IMG500 and an overlapping region B511 in the screen IMG510. In this case, the multi-screen display IMG530 will end up being a screen in which luminance correction of the edge-blending function has been applied to a portion of the overlapping regions G501 and G511.

Thus, luminance uniformity cannot be realized with the free-layout multi-screen display configuration disclosed in Japanese Patent Laid-Open No. 2006-243200 and with the multi-screen display configuration using projection-type image display apparatuses with different screen sizes disclosed in Japanese Patent Laid-Open No. 2007-206356. Note that a technique related to setting overlapping regions for the individual projection-type image display apparatuses and luminance correction of the overlapping regions is not disclosed in Japanese Patent Laid-Open No. 2007-206356 in the first place.

SUMMARY OF THE INVENTION

According to one aspect of the present invention, there is provided an image processing apparatus comprising: a specification unit configured to, from a multi-screen display corresponding to multi-screen displays performed by a plurality of projection apparatuses, specify an overlapping region in which a first projection region for a first projection apparatus and a second projection region for a second projection apparatus overlap; a determination unit configured to, based on the position of the overlapping region in the first projection region and the position of the overlapping region in the second projection region, determine luminance correction coefficients corresponding to the overlapping region such that the luminance correction coefficient at a coordinate corresponding to a first vertex in the overlapping region and a luminance correction coefficient at a coordinate corresponding to a second vertex located diagonally opposite to the first vertex in the overlapping region are different; and a correction unit configured to correct luminance of image data for the multi-screen display, based on the correction coefficients determined by the determination unit.

Further features of the present invention will become apparent from the following description of exemplary embodiments with reference to the attached drawings.

BRIEF DESCRIPTION OF THE DRAWINGS

FIG. 2 is a diagram showing an example of correction values in an LUT according to the first embodiment of the present invention.

DESCRIPTION OF THE EMBODIMENTS

Exemplary embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
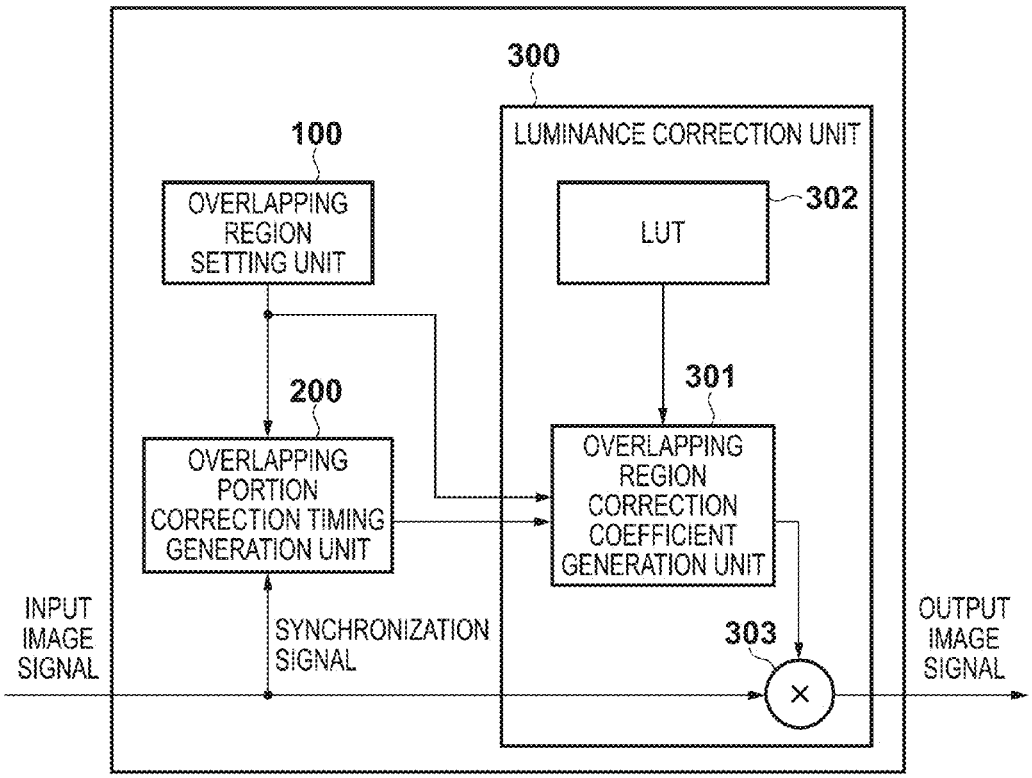
FIG. 1 is a diagram showing schematic blocks of an image display apparatus according to a first embodiment of the present invention.

FIG. 1 shows an example of schematic blocks for a projection-type image display apparatus (image processing apparatus) according to a first embodiment. The projection-type image display apparatus has a function of projecting part of a multi-screen display configured using multiple projection-type image display apparatuses. The projection-type image display apparatus includes an overlapping region setting unit 100, an overlapping portion correction timing generation unit 200, and a luminance correction unit 300, and the processing units are controlled by a control unit such as a CPU (not shown).

The overlapping region setting unit 100 sets an overlapping region in the multi-screen display configuration. For example, it sets the overlapping region using a start coordinate and an end coordinate in the direction perpendicular to the overlap direction of the image, and a width in the overlap direction. The overlapping portion correction timing generation unit 200 generates pixel positions in the image overlapping region based on a synchronization signal.

The luminance correction unit 300 includes an overlapping region correction coefficient generation unit 301, a correction coefficient storage unit (here, an LUT) 302, and a multiplier 303. The overlapping region correction coefficient generation unit 301 calculates luminance correction coefficients to be applied to an input image based on luminance correction values read out from an LUT 302 in accordance with the pixel positions in the image overlapping region generated by the overlapping portion correction timing generation unit 200. The multiplier 303 uses the luminance correction coefficients calculated by the overlapping region correction coefficient generation unit 301 to multiply the input image by the luminance correction coefficients, and thereby performs luminance correction. For example, as shown in FIG. 2, the LUT 302 has correction coefficients according to which [correction coefficient at address (n, m)]+[correction coefficient at address (m, n)]=1 (n, m≤8). That is to say, the LUT 302 has correction values according to which corrected luminance values gradually decrease from 100% to 0%, from one of two diagonally opposing vertices (address (8, 0)) to the other (address (0, 8)). Note that FIG. 2 shows an example of gradually decreasing from an address (n, m) to an address (m, n), but the present invention is not limited thereto, and it is possible to gradually increase from an address (n, m) to an address (m, n). Also, it is also possible to gradually decrease or increase from an address (n, m) to an address (8−m, 8−n). Note that for the description below, the address (0, 0) will be A", the address (8, 0) will be A, the address (8, 7) will be A', the address (0,1) will be B', the address (0, 8) will be B, and the address (8, 8) will be B". Also, in the present description, the LUT 302 is a 9×9 table, but the present invention is not limited thereto.

Figure 3:
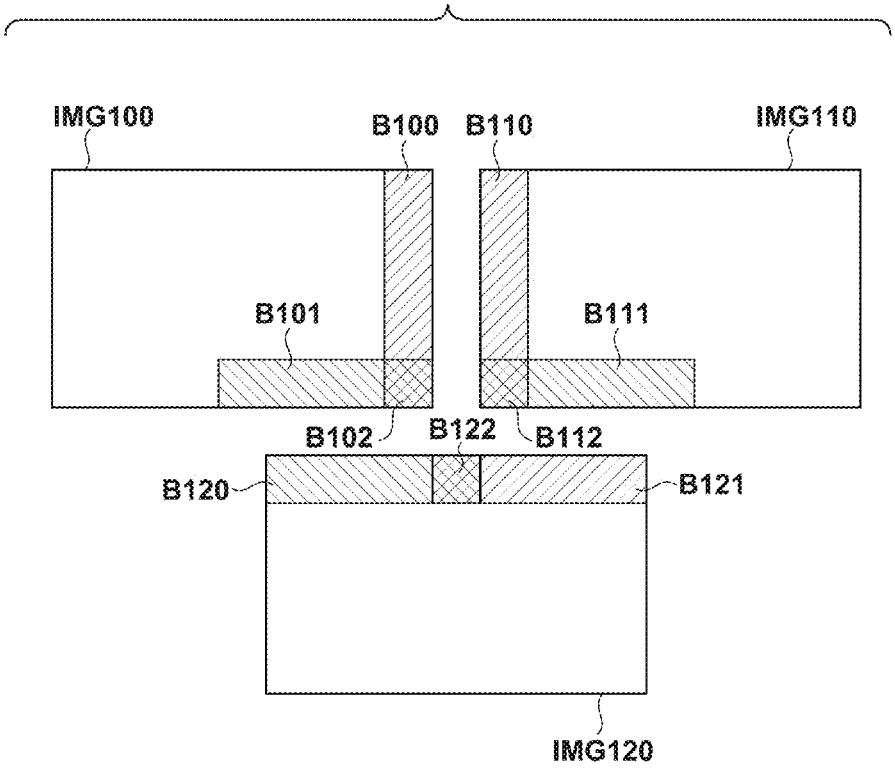
FIG. 3 is a diagram for describing a multi-screen display configuration with a "T-shaped" layout according to the first embodiment of the present invention.

Here, an example will be described in which a multi-screen display is constituted by laying out, in a "T shape", three screens that are each 1920 pixels wide and 1200 pixels high at an overlap width of 300 pixels. In FIG. 3, in a screen IMG100, vertical start coordinate=0, vertical end coordinate=1199, and overlapping region width=300 are set for an overlapping region B100 from the right side in the horizontal direction. Also, horizontal start coordinate=810, horizontal end coordinate=1919, and overlapping region width=300 are set for an overlapping region B101 from the lower side in the vertical direction. Note that here, a region B102 in which the overlapping region B100 and the overlapping region B101 overlap is set such that it is included in both the overlapping region B100 and the overlapping region B101. In a screen IMG110, vertical start coordinate=0, vertical end coordinate=1199, and overlapping region width=300 are set for an overlapping region B110 from the left side in the horizontal direction. Also, horizontal start coordinate=0, horizontal end coordinate=1109, and overlapping region width=300 are set for an overlapping region B111 from the lower side in the vertical direction. Note that here, the region B112 in which the overlapping region B110 and the overlapping region B111 overlap is set such that it is included in both the overlapping region B110 and the overlapping region B111. In a screen IMG120, horizontal start coordinate=0, horizontal end coordinate=1109, and overlapping region width=300 are set for an overlapping region B120 from the upper side in a first vertical direction. Also, horizontal start coordinate=810, the horizontal end coordinate=1919, and overlapping region width=300 are set for an overlapping region B121 from the upper side in a second vertical direction. Note that here, a region B122 in which the overlapping region B120 and the overlapping region B121 overlap is set such that it is included in both the overlapping region B120 and the overlapping region B121. Here, for example, since the overlapping region B102 of the screen IMG100 is a region that is determined uniquely based on the setting of the overlapping region B100 and the overlapping region B101, it is set such that it is included in both the overlapping region B100 and the overlapping region B101.

Note that in the present embodiment, a description has been given in which the setting of the overlapping regions is performed by setting a start coordinate, an end coordinate, and a width for each vertical or horizontal direction, but setting may be performed using absolute coordinates in the image. In such a case, start point coordinates (1619, 0) and end point coordinates (1919, 1199) are set for the overlapping region B100. Start point coordinates (810, 899) and end point coordinates (1919, 1199) are set for the overlapping region B101. Also, it is possible to set the overlapping region B102 such that it is separate. In such a case, the overlapping region setting unit 100 sets start point coordinates (1619, 0) and end point coordinates (1919, 899) for the overlapping region B100. Start point coordinates (810, 899) and end point coordinates (1619, 1199) are set for the overlapping region B101. Start point coordinates (1619, 899) and end point coordinates (1919, 1199) are set for the overlapping region B102.

Figure 4A:
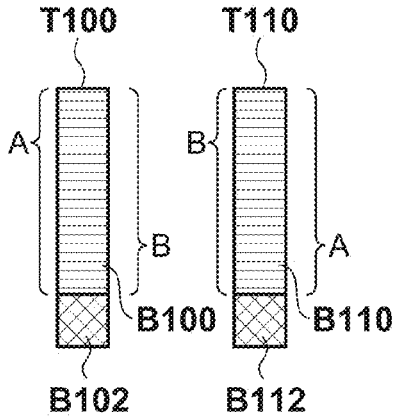
FIGS. 4A to 4D are diagrams for describing luminance correction coefficients for overlapping regions in a multi-screen display configuration with a "T-shaped" layout according to the first embodiment of the present invention.

Luminance correction of these regions in the above-described region setting will be described below. The overlapping region B100 and the overlapping region B110 are regions that extend over the entirety of the screen vertical direction, and the images thereof are overlapped from the horizontal direction. Accordingly, the luminance correction unit 300 that is involved in display of the screen IMG100 generates luminance correction coefficients such that, in the overlapping region B100, the luminance correction coefficients gradually decrease from a first value (e.g., 1) to a second value (e.g., 0) from the left end to the opposing right end of the overlapping region and the luminance correction coefficients in the vertical direction are uniform, as shown in T100 in FIG. 4A. That is to say, luminance correction coefficients are generated using correction values at addresses on a diagonal line from the address (8, 0) to the address (0, 8) of the LUT 302, according to the coordinate in the horizontal direction in the overlapping region. Also, the luminance correction unit 300 that is involved in display of the screen IMG110 generates luminance correction coefficients such that, in the overlapping region B110, the luminance correction coefficients gradually increase from a second value (e.g., 0) to a first value (e.g., 1) from the left end to the right end of the overlapping region and the luminance correction coefficients in the vertical direction are uniform, as shown in T110 in FIG. 4A. That is to say, the luminance correction coefficients are generated using the correction values at the addresses on the diagonal line from the address (0, 8) to the address (8, 0) of the LUT 302, according to the coordinate in the horizontal direction in the overlapping region. In other words, the overlapping region correction coefficient generation unit 301 of the present embodiment determines the luminance correction coefficients for the overlapping regions (B100 and B110), based on the position of the overlapping region (B100) in a first projection region (IMG100) and on the position of the overlapping region (B110) in another projection region (IMG110). Here, the correction coefficients in corresponding positional relationships in T100 and T110 are 1 in the entire region upon being added together. Note that in the overlapping region B100 and the overlapping region B110, the luminance correction values are applied to regions not including the overlapping region B102 and the overlapping region B112. The overlapping region B102 and the overlapping region B112 are regions in which images are overlapped from both the horizontal direction and the vertical direction, and since the methods for generating the luminance correction coefficients thereof are different, they will be described later. Note that although a description will be given below in which the first value is 1 and the second value is 0, the present invention is not necessarily limited to these values, and the second value is applicable as a value that is smaller than the first value. In this case, it is sufficient that the luminance correction coefficients for the pixels of the overlapping region are generated as values that are less than or equal to the first value and greater than or equal to the second value.

Figure 4B:
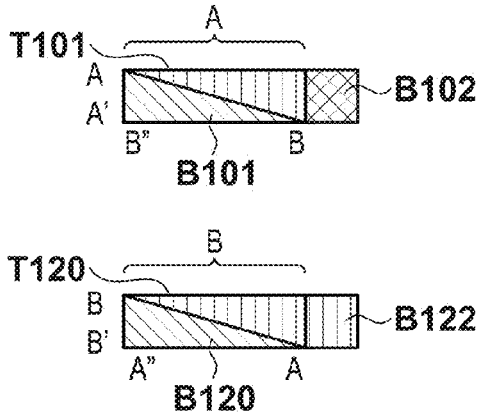

The overlapping region B101 and the overlapping region B120 are partial regions in the screen in the horizontal direction, in which images are overlapped in a left-oblique direction. In this case, among the four sides of the overlapping region B101, the luminance correction coefficients for the side on the screen interior side are 1, and the luminance correction coefficients for the side on the screen exterior side are 0, and the luminance correction coefficients for the side in contact with the overlapping region B102 gradually decrease from 1 to 0 from the screen interior side to the screen exterior side. As a result, for the luminance correction of the overlapping region B101, the luminance correction unit 300 involved in the display of the screen IMG100 generates different luminance correction coefficients in two regions partitioned using the vertex of the overlapping region B101 that is located on the screen interior side and the vertex that is diagonally opposite thereto. In other words, as shown in T101 in FIG. 4B, the correction values surrounded by A-A'-B"-B in the LUT 302 are applied to the region with oblique hatching. Also, for the region with vertical hatching, the correction values at the addresses on the diagonal line from address (8, 0) to address (0, 8) in the LUT 302 are used to generate luminance correction coefficients that gradually decrease in the vertical direction and that are uniform in the horizontal direction. Thus, in the present embodiment, the luminance correction coefficients for correcting the luminance of the image data in the overlapping regions are determined based on the overlap pattern of the multi-screen display. Note that the overlap pattern is a pattern corresponding to the overlapping direction (vertical, horizontal, or oblique). Also, the overlap pattern can be specified based on the position of the overlapping regions on the projection region. Also, the overlap pattern can also be designated by a user.

Note that for the luminance correction of the overlapping region B120, the luminance correction unit 300 involved in the display of the screen IMG120 generates different luminance correction coefficients in two regions partitioned using the vertex of the overlapping region B120 that is located on the screen interior side and the vertex that is diagonally opposite thereto. In other words, as shown in T120 in FIG. 4B, the correction values surrounded by B-B'-A"-A in the LUT 302 are applied to the region with oblique hatching. Also, for the region with vertical hatching, the correction values at the addresses on the diagonal line from address (0, 8) to address (8, 0) in the LUT 302 are used to generate luminance correction coefficients that gradually increase in the vertical direction and that are uniform in the horizontal direction. Thus, the overlapping region correction coefficient generation unit 301 of the present embodiment determines the luminance correction coefficients for the overlapping regions (B101 and B120) based on the position of the overlapping region (B101) in a first projection region (IMG100) and on the position of the overlapping region (B120) in another projection region (IMG120). Here, the correction coefficients in T101 and T120 that are in corresponding positional relationships are 1 in the entire region upon being added together. Note that the luminance correction values are applied to regions not including the overlapping region B102 and the overlapping region B122 in the overlapping region B101 and the overlapping region B120.

Figure 4C:
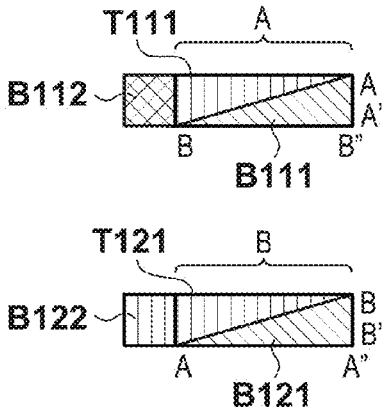
Figure 4D:
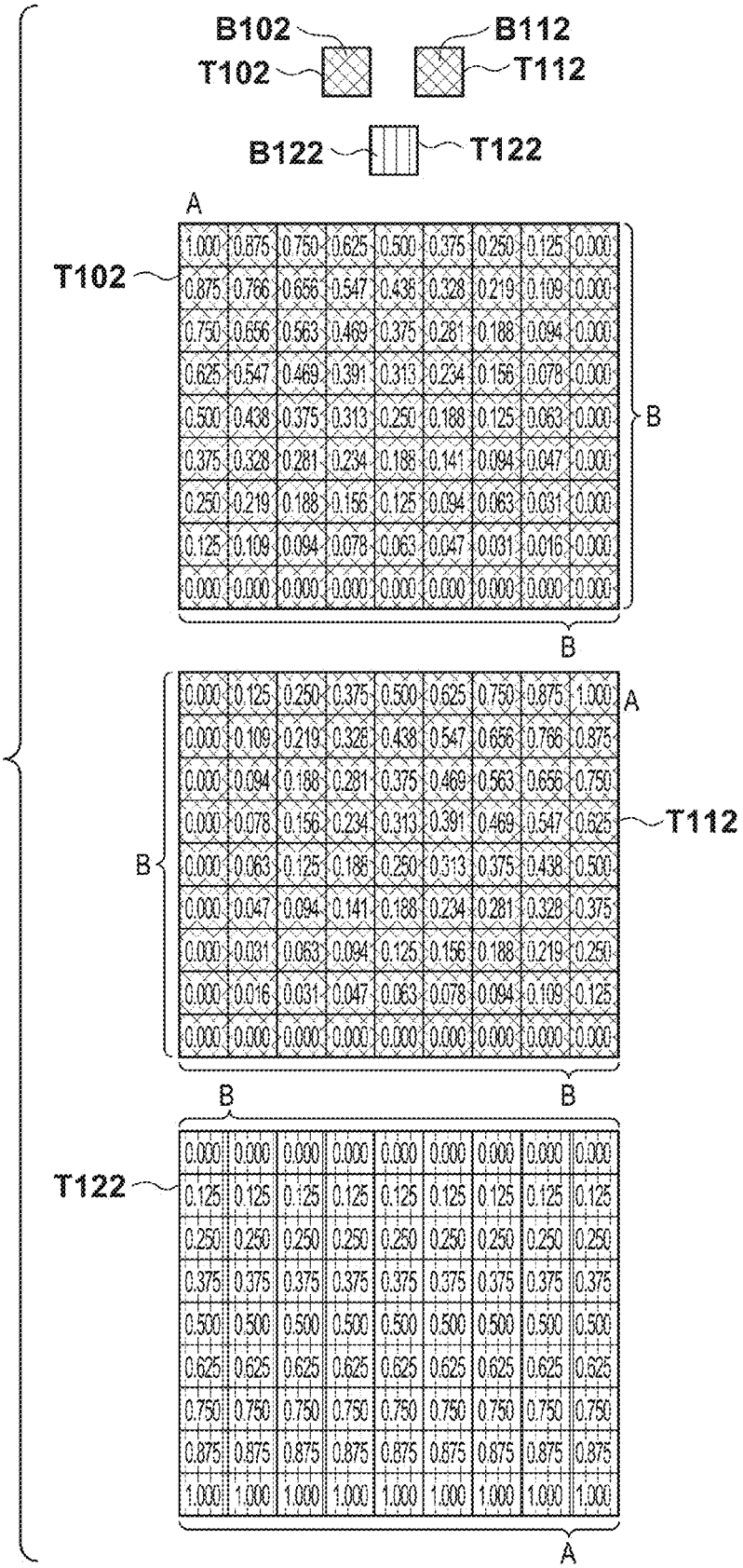

In the overlapping region B122, the overlapping region B102 and the overlapping region B112 are overlapped from the vertical direction. Accordingly, in the overlapping region B122, the luminance correction unit 300 involved in the display of the screen IMG120 generates luminance correction coefficients such that the luminance correction coefficients gradually increase from 0 to 1 from the upper end to the lower end of the overlapping region and the luminance correction coefficients in the horizontal direction are uniform, as shown in T122 in FIG. 4D. That is to say, according to the coordinates in the vertical direction in the overlapping region, the luminance correction coefficients are generated using the correction values at the addresses on the diagonal line from the address (0, 8) to the address (8, 0) in the LUT 302. The method for generating the luminance correction coefficients in the overlapping region B102 will be described below.

Next, the overlapping region B111 and the overlapping region B121 are partial regions of the screen in the horizontal direction, in which images are overlapped in a right oblique direction. In this case, the luminance correction coefficients for the side on the screen interior side of the overlapping region B111 are 1, the luminance correction coefficients for the side on the screen exterior side of the overlapping region B111 are 0, and the luminance correction coefficients for the side in contact with the overlapping region B112 gradually decrease from 1 to 0 from the screen interior side to the screen exterior side. As a result, the luminance correction of the overlapping region B111, the luminance correction unit 300 involved in the display of the screen IMG110 generates different luminance correction coefficients in two regions partitioned using the vertex of the overlapping region B111 that is located on the screen interior side and the vertex that is diagonally opposite thereto. In other words, as shown in T111 of FIG. 4C, the correction values surrounded by A-A'-B"-B in the LUT 302 are applied to the region with oblique hatching. Also, for the region with vertical hatching, the correction values at the addresses on the diagonal line from the address (8, 0) to the address (0, 8) in the LUT 302 are used to generate luminance correction coefficients that gradually decrease in the vertical direction and that are uniform in the horizontal direction.

Note that for the luminance correction of the overlapping region B121, the luminance correction unit 300 involved in the display of the screen IMG120 generates different luminance correction coefficients in two regions partitioned using the vertex of the overlapping region B121 that is located on the screen interior side and the vertex that is diagonally opposite thereto. In other words, as shown in T121 in FIG. 4C, the correction values surrounded by B-B'-A"-A in the LUT 302 are applied to the region with oblique hatching. Also, for the region with vertical hatching, the correction values at the addresses on the diagonal line from the address (0, 8) to the address (8, 0) in the LUT 302 are used to generate luminance correction coefficients that gradually increase in the vertical direction and that are uniform in the horizontal direction. Here, the correction coefficients in T111 and T121 that are in corresponding positional relationships are 1 in the entire region upon being added together. Note that in the overlapping region B111 and the overlapping region B121, the luminance correction values are applied to regions not including the overlapping region B112 and the overlapping region B122. The generation of luminance correction coefficients for the overlapping region B122 is as described above, and the method for generating the luminance correction coefficients for the overlapping region B112 will be described below.

The images of the overlapping region B102 and the overlapping region B112 are overlapped from the horizontal direction, the vertical direction, and the oblique direction if it is considered that there are two overlapping regions B122, namely the region in the overlapping region B120 and the region in the overlapping region B121. For this reason, as shown in T102 in FIG. 4D, in the overlapping region B102, the luminance correction value for the vertex located on the screen interior side is 1, and the luminance correction values gradually decrease toward the sides on the image edge such that the luminance correction values are 0. That is to say, the correction values at the addresses on the diagonal line from address (8, 0) to address (0, 8) in the LUT 302 are used to obtain the horizontal/vertical luminance correction values corresponding to the pixel positions in the overlapping region B102, and these are multiplied together to generate the luminance correction values. Also, similarly, in the overlapping region B112 as well, the luminance correction value for the vertex located on the screen interior side is 1, and the luminance correction values gradually decrease toward the sides on the image edges such that the luminance correction values are 0, as shown in T112 in FIG. 4D. That is to say, the correction values at the addresses on the diagonal line from the address (8, 0) to the address (0, 8) in the LUT 302 are used to obtain the horizontal/vertical luminance correction values corresponding to the pixel positions in the overlapping region B102, and these are multiplied together to generate the luminance correction values. Here, in T102 and T112, upon adding the correction coefficients in corresponding positional relationships together, the luminance correction coefficients gradually decrease from 1 to 0 from the upper side of the overlapping regions to the lower side, and the luminance correction coefficients in the horizontal direction are uniform. Also, upon adding T102, T112, and T122 together, the luminance correction coefficients are 1 in the entire region.

Note that although FIGS. 4A to 4D show the luminance correction coefficients T100 to T102, T110 to T112, T120 to T122 as 9×9 tables, this is a conceptual rendering showing a distribution of luminance correction coefficients, and in actuality, luminance correction coefficients corresponding to the region pixels of the overlapping regions are generated. Also, in the present embodiment, a description was given in which the overlapping region correction coefficient generation unit 301 generates luminance correction coefficients using the luminance correction coefficients included in the LUT 302, but the present invention is not limited to this, and luminance correction coefficients may be calculated in the overlapping region correction coefficient generation unit 301.

As described above, according to the present embodiment, an overlapping region can be set to be a portion of one side of a screen. Also, for overlapping in the oblique direction, by performing correction such that the luminance value in one of two diagonally opposing vertices of the overlapping region is 100% and the luminance values gradually decrease so as to be 0% at the other vertex, it is possible to correct the composite luminance of the overlapping region so that it is uniform.

Accordingly, it is possible to provide a projection-type image display apparatus in which the uniformity in the luminance of a screen is maintained even if multi-screen display in a "T-shaped" layout is configured.

Second Embodiment

A schematic block configuration of a projection-type image display apparatus (image processing apparatus) according to a second embodiment is the same as that of the first embodiment. In the present embodiment, an example will be described in which multi-screen display is configured by "obliquely" laying out two screens that are each 1920 pixels wide and 1200 pixels high with an overlap width of 300 pixels.

Figure 5:
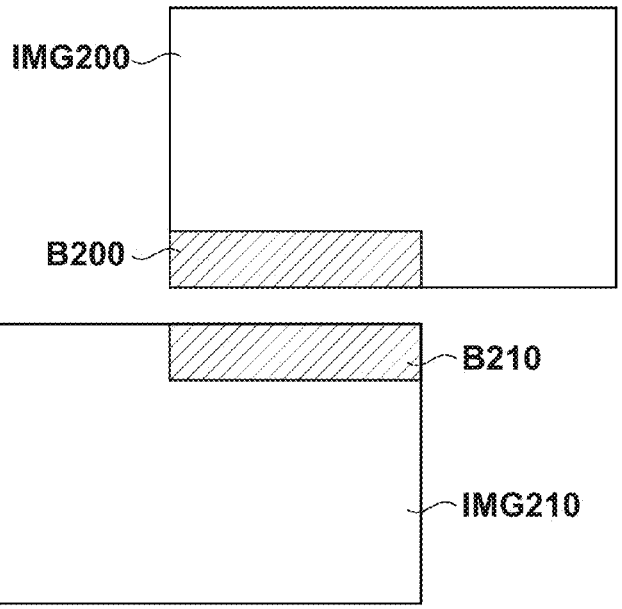
FIG. 5 is a diagram for describing a multi-screen display configuration with an "oblique" layout and luminance correction coefficients for an overlapping region according to a second embodiment of the present invention.

Specifically, as shown in FIG. 5, in a screen IMG200, start point coordinates (0, 899) and end point coordinates (1109, 1199) are set for an overlapping region B200 from the oblique lower-left direction. In a screen IMG210, start point coordinates (1110, 0) and end point coordinates (1919, 299) are set for an overlapping region B210 from the oblique upper-right direction.

Luminance correction of these regions in the above-described region setting will be described below. The images of the overlapping region B200 and the overlapping region B210 are overlapped from an oblique direction. Accordingly, for the luminance correction of the overlapping region B200, the luminance correction unit 300 involved in the display of the screen IMG200 generates luminance correction coefficients such that the luminance correction coefficients gradually decrease from 1 to 0 in a direction from the vertex position on the image interior side to the vertex position on the image edge, as shown in T200 in FIG. 5. These are luminance correction coefficients with the same distribution as the LUT 302. Also, the luminance correction unit 300 involved in the display of the screen IMG 210 similarly generates luminance correction coefficients for the overlapping region B210. These are luminance correction coefficients with a distribution that is the horizontal and vertical inverse of the LUT 302. Here, the correction coefficients in corresponding positional relationships in T200 and T210 are 1 in the entire region upon being added together.

Note that although the luminance correction coefficients T200 and T210 are indicated as 9×9 tables in FIG. 5, this is a conceptual rendering showing the distribution of luminance correction coefficients, and in actuality, luminance correction coefficients corresponding to the region pixels of the overlapping regions are generated. Also, in the present embodiment, a description was given in which the overlapping region correction coefficient generation unit 301 generates luminance correction coefficients using the luminance correction coefficients included in the LUT 302, but the present invention is not limited to this, and luminance correction coefficients may be calculated in the overlapping region correction coefficient generation unit 301.

As described above, according to the present embodiment, an overlapping region can be set to be a portion of one side of a screen. Also, for overlapping in the oblique direction, by performing correction such that the luminance value in one of two diagonally opposing vertices of the overlapping region is 100% and the luminance values gradually decrease so as to be 0% at the other vertex, it is possible to correct the composite luminance of the overlapping region so that it is uniform.

Accordingly, it is possible to provide a projection-type image display apparatus according to which uniformity in the luminance of a screen is maintained even if multi-screen display in an "oblique" layout is configured.

Third Embodiment

The schematic blocks of a projection-type image display apparatus (image processing apparatus) according to a third embodiment are the same as those of the first embodiment. In the present embodiment, an example will be described in which a multi-screen display is constituted by laying out, in an "L shape", three screens that are each 1920 pixels wide and 1200 pixels high with an overlap width of 300 pixels.

In FIGS. 6A to 6D, start point coordinates (1619, 300) and end point coordinates (1619, 1199) are set for an overlapping region B300 from the right side in the horizontal direction for a screen IMG300. Also, start point coordinates (1619, 0) and end point coordinates (1619, 299) are set for an overlapping region B301 from the right side and the upper right side in the horizontal direction.

For a screen IMG310, start point coordinates (300, 899) and end point coordinates (1919, 1199) are set for an overlapping region B310 from the lower side in the vertical direction. Also, start point coordinates (0, 899) and end point coordinates (299, 1199) are set for an overlapping region B311 from the lower side in the vertical direction and the lower left side. In a screen IMG320, start point coordinates (0, 0) and end point coordinates (299, 1199) are set for an overlapping region B320 from the left side in the horizontal direction. Also, start point coordinates (0, 0) and end point coordinates (1919, 299) are set for an overlapping region B321 from the upper side in the vertical direction. Note that an overlapping region B322 is set such that it is included in the overlapping region B320 and the overlapping region B321.

Note that since the screen IMG300 has no overlapping region from the upper side at coordinates that connect to the overlapping region B301, the overlapping region B301 needs to be set explicitly, unlike in the first embodiment. Also, since the screen IMG310 has no overlapping region from the left at coordinates that connect to the overlapping region B311, the overlapping region B311 similarly needs to be set explicitly.

Figure 6A:
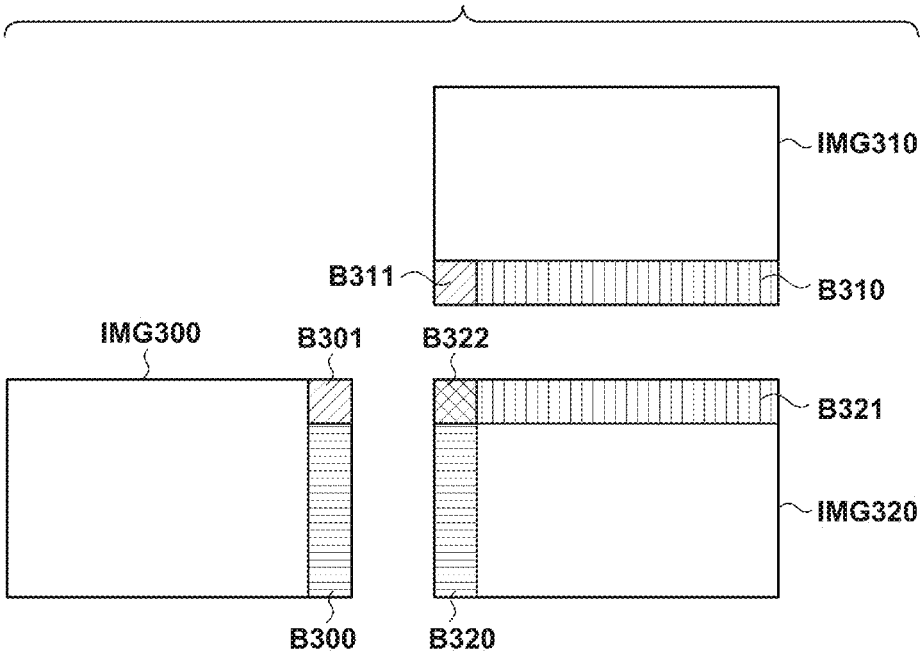
FIGS. 6A to 6D are diagrams for describing a multi-screen display configuration with an "L-shaped" layout and luminance correction coefficients for overlapping regions according to the third embodiment of the present invention.

Luminance correction of these regions in the region setting will be described below. As shown in FIG. 6A, the overlapping region B300 and the overlapping region B320 are regions that span the entirety of the screen vertical direction and connect to the overlapping region B301 and the overlapping region B322 respectively, and the images thereof are overlapped from the horizontal direction. Accordingly, the luminance correction unit 300 that is involved in display of the screen IMG300 generates luminance correction coefficients such that, in the overlapping region B300, the luminance correction coefficients gradually decrease from 1 to 0 from the left end to the right end of the overlapping region, and the luminance correction coefficients in the vertical direction are uniform, as shown in T300 in FIG. 6B. That is to say, the luminance correction coefficients are generated using the correction values at the addresses on the diagonal line from the address (8, 0) to the address (0, 8) in the LUT 302, according to the coordinate in the horizontal direction in the overlapping region. Also, the luminance correction unit 300 that is involved in display of the screen IMG320 generates luminance correction coefficients such that, in the overlapping region B320, the luminance correction coefficients gradually increase from 0 to 1 from the left end to the right end of the overlapping region, and the luminance correction coefficients in the vertical direction are uniform, as shown in T320 in FIG. 6B. That is to say, the luminance correction coefficients are generated using the correction values at the addresses on the diagonal line from the address (0, 8) to the address (8, 0) in the LUT 302, according to the coordinate in the horizontal direction in the overlapping region. Here, the correction coefficients in corresponding positional relationships in T300 and T320 are 1 in the entire region upon being added together.

As shown in FIG. 6A, the overlapping region B310 and the overlapping region B321 are regions that span the entirety of the screen horizontal direction and connect to the overlapping region B311 and the overlapping region B322 respectively, and the images thereof are overlapped from the vertical direction. Accordingly, the luminance correction unit 300 that is involved in display of the screen IMG310 generates luminance correction coefficients such that, in the overlapping region B310, the luminance correction coefficients gradually decrease from 1 to 0 from the upper end to the lower end of the overlapping region, and the luminance correction coefficients in the horizontal direction are uniform, as shown in T310 in FIG. 6C. That is to say, the luminance correction coefficients are generated using the correction values at the addresses on the diagonal line from the address (8, 0) to the address (0, 8) in the LUT 302, according to the coordinate in the horizontal direction in the overlapping region. Also, in the overlapping region B321, the luminance correction unit 300 involved in the display of the screen IMG320 generates luminance correction coefficients such that the luminance correction coefficients gradually increase from 0 to 1 from the upper end to the lower end of the overlapping region and the luminance correction coefficients in the horizontal direction are uniform, as shown in T321 in FIG. 6C. That is to say, the luminance correction coefficients are generated using the correction values at the addresses on the diagonal line from the address (0, 8) to the address (8, 0) in the LUT 302, according to the coordinate in the horizontal direction in the overlapping region. Here, the correction coefficients in corresponding positional relationships in T310 and T321 are 1 in the entire region upon being added together.

As shown in FIG. 6A, images in the overlapping region B322 are overlapped from the horizontal direction and the vertical direction. For this reason, in the overlapping region B322, as shown in T322 in FIG. 6D, the luminance correction value at the vertex located on the screen interior side is 1, and the luminance correction values gradually decrease toward the side in contact with the image edges until reaching 0. That is to say, the correction values at the addresses on the diagonal line from address (8, 0) to address (0, 8) in the LUT 302 are used to obtain the horizontal/vertical luminance correction values corresponding to the pixel positions in the overlapping region B322, and these are multiplied together to generate the luminance correction values.

The composite luminance of the overlapping region B301 and the overlapping region B311 needs to be 100% in the entire region after being further composited with the overlapping region B322. Accordingly, since the overlapping region B301 and the overlapping region B311 are overlapped in the oblique direction, luminance correction coefficients obtained by subtracting the luminance correction coefficients of T322 from 1 are the luminance correction coefficients distributed in the oblique direction.

Figure 6B:
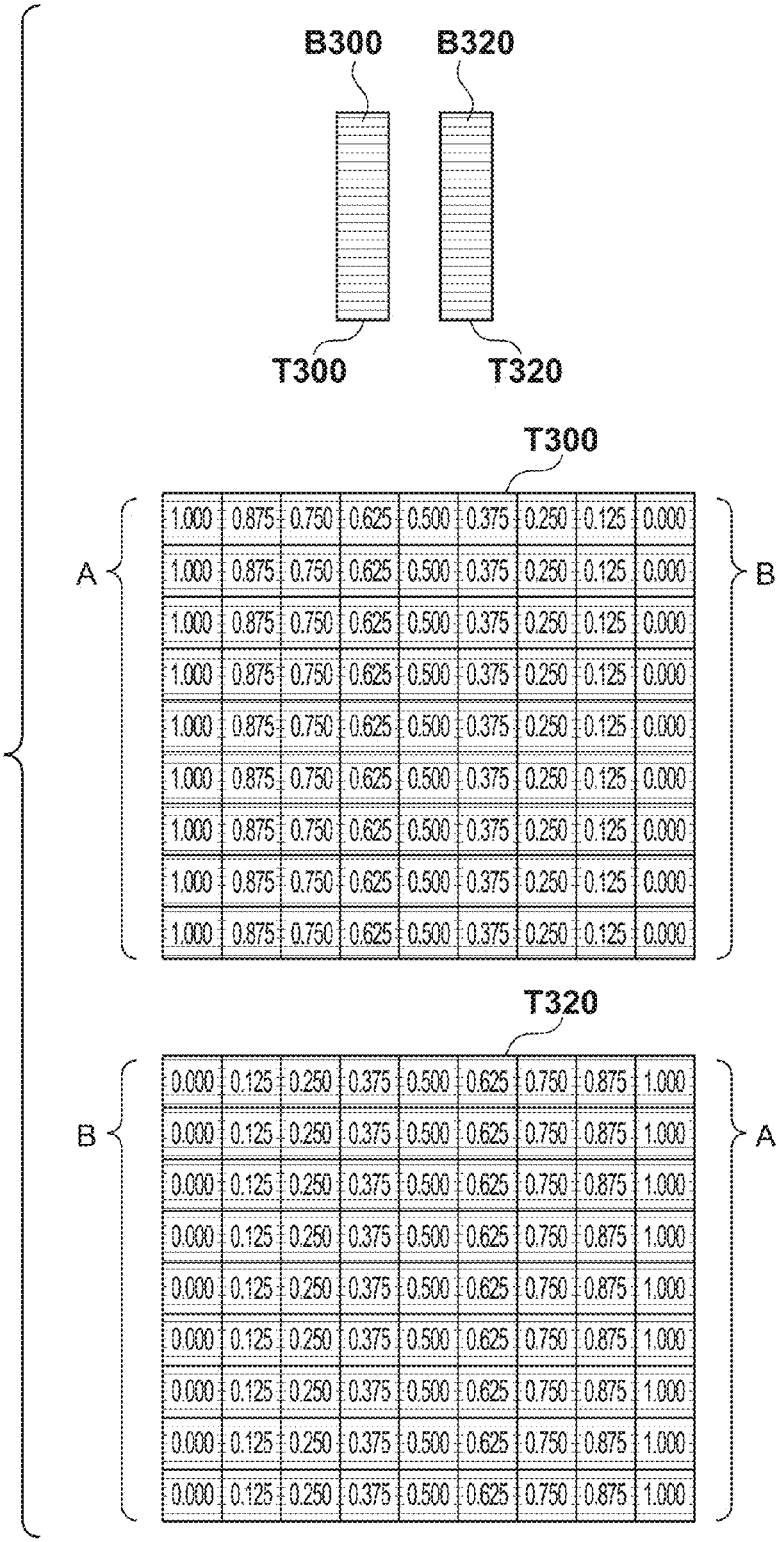
Figure 6C:
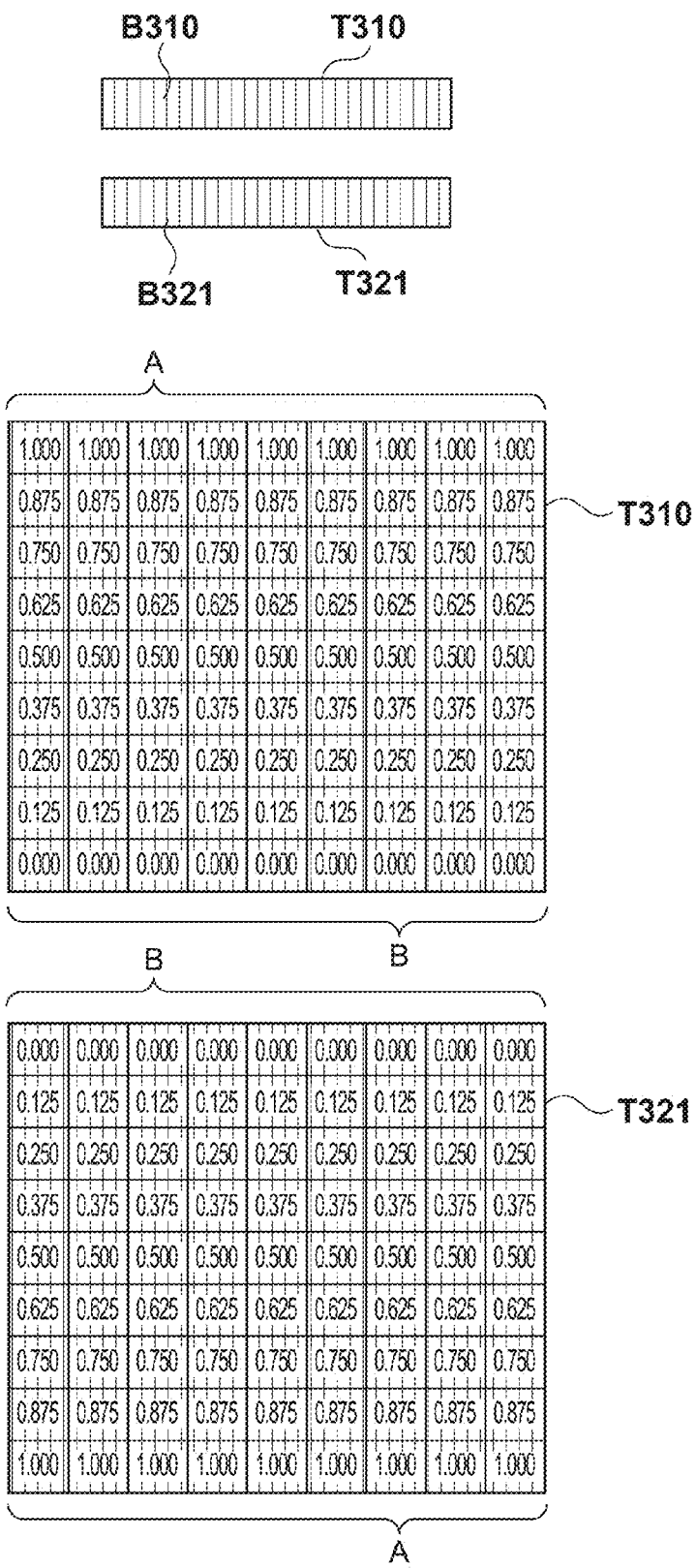
Figure 6D:
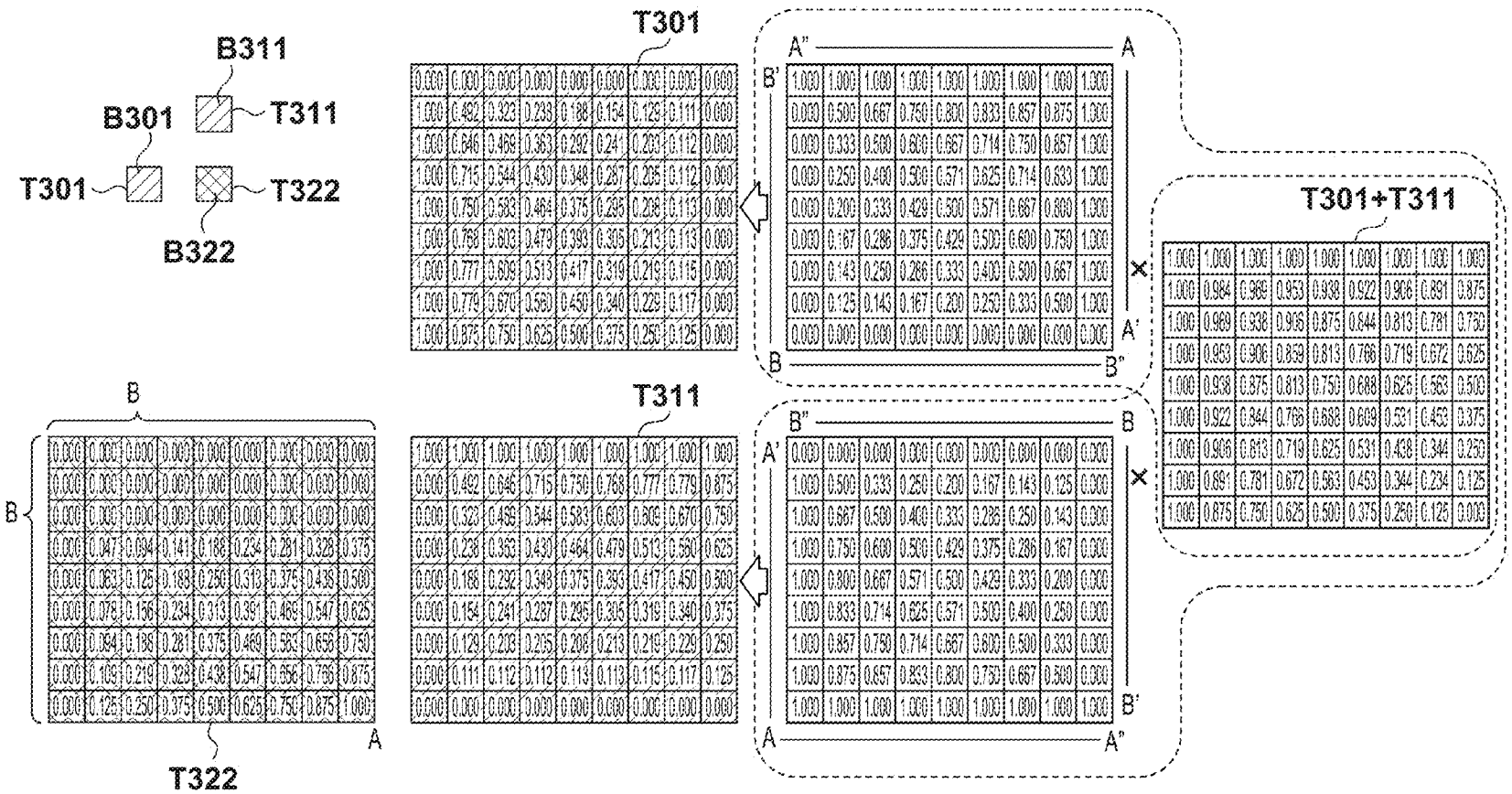

In other words, as shown in FIG. 6D, the luminance correction coefficients are obtained by multiplying the table in the LUT 302 and the vertical and horizontal inverse of the table in the LUT 302 by [T301+T311] respectively. Here, in T301+T311, the luminance correction coefficients on the upper end side and on the left end side are 1 and become 0 toward the lower right vertex position. Accordingly, the total of the luminance correction coefficients with respect to an area pixel is 1.

Note that although FIGS. 6B to 6D show the luminance correction coefficients T300 to T301, T310 to T311, and T320 to T322 as 9×9 tables, this is a conceptual rendering showing a distribution of luminance correction coefficients, and in actuality, luminance correction coefficients corresponding to the pixels of the overlapping regions are generated. Also, in the present embodiment, although a description was given in which the overlapping region correction coefficient generation unit 301 generates a luminance correction coefficient using the luminance correction coefficients included in the LUT 302, the present invention is not limited to this, and the luminance correction coefficients may be calculated by a calculating means in the overlapping region correction coefficient generation unit 301.

As described above, according to the present embodiment, the two overlapping regions can be set on one side of the screen. Also, for overlapping in the oblique direction, by performing correction such that the luminance value in one of two diagonally opposing vertices of the overlapping region is 100% and the luminance values gradually decrease so as to be 0% at the other vertex, it is possible to correct the composite luminance of the overlapping region so that it is uniform.

Accordingly, it is possible to provide a projection-type image display apparatus in which the uniformity in the luminance of a screen is maintained even if multi-screen display in an "L-shaped" layout is configured.

Fourth Embodiment

In the first to third embodiments, a description was given for luminance correction coefficients in a relationship in which the luminance increases or decreases linearly with respect to an increase or a decrease in the pixel value. In order to have a relationship in which the luminance increases or decreases linearly with respect to an increase or decrease in the pixel values, de-gamma/gamma processing units according to which consideration is given to the gamma characteristics of the display apparatus generally need to be included in front of and behind the luminance correction unit. Incidentally, instead of including the de-gamma/gamma processing units, it is conceivable to use, as the luminance correction coefficients included in the LUT 302, luminance correction coefficients obtained with consideration given to the gamma characteristics. The luminance correction coefficients in the first and second embodiments are the luminance correction coefficients in the LUT 302 themselves, or are calculated by multiplying the luminance correction coefficients together. For this reason, in the above description, there is no problem if "the correction coefficients in corresponding overlapping regions are 1 in the entire region upon being added together" is changed to "the corresponding corrected luminances of the overlapping regions become 1 in the entire region upon being added together". Incidentally, since the luminance correction coefficients in the third embodiment include subtraction of the calculated luminance correction coefficients from the luminance correction coefficients included in the LUT 302, a problem arises in the case of using luminance correction coefficients obtained with consideration given to the gamma characteristics.

Figure 7:
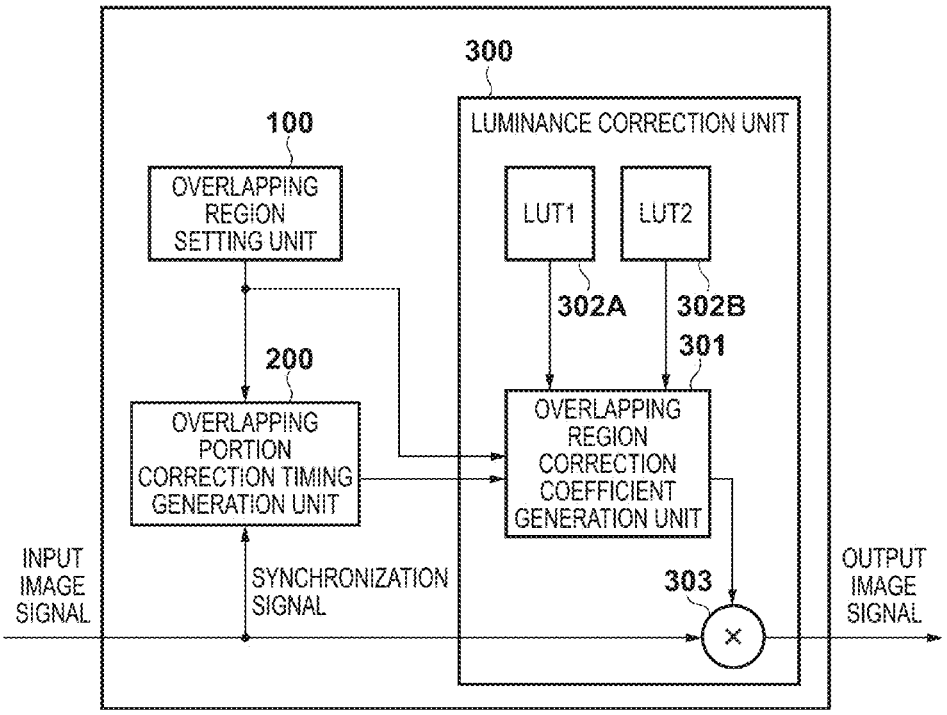
FIG. 7 is a diagram showing schematic blocks of an image display apparatus according to a fourth embodiment of the present invention.
Figure 8B:
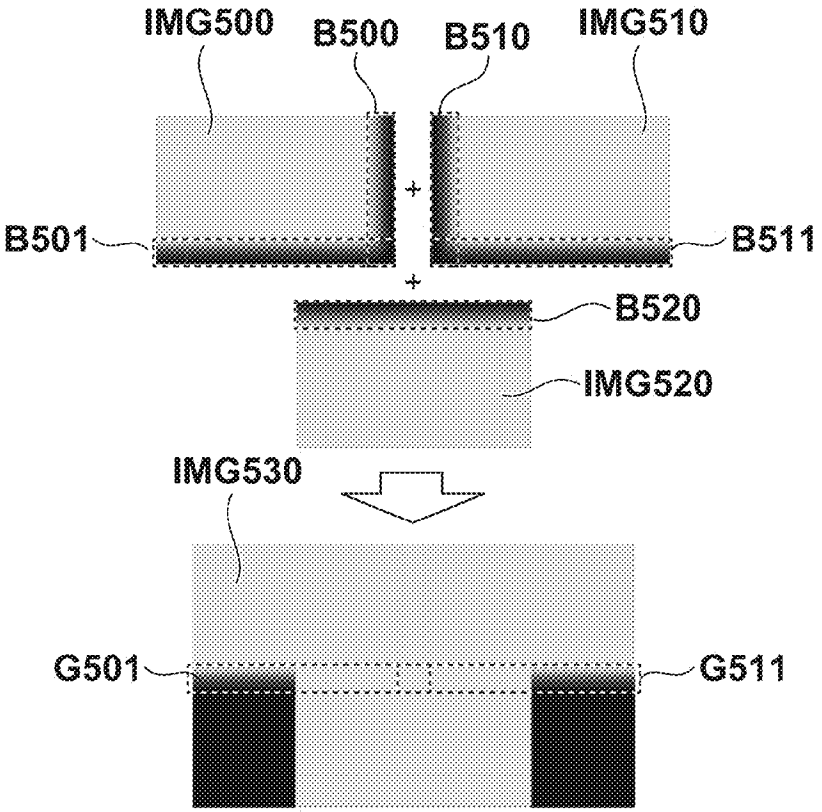
FIGS. 8A and 8B are diagrams for describing a conventional luminance correction method.
Figure 8A:
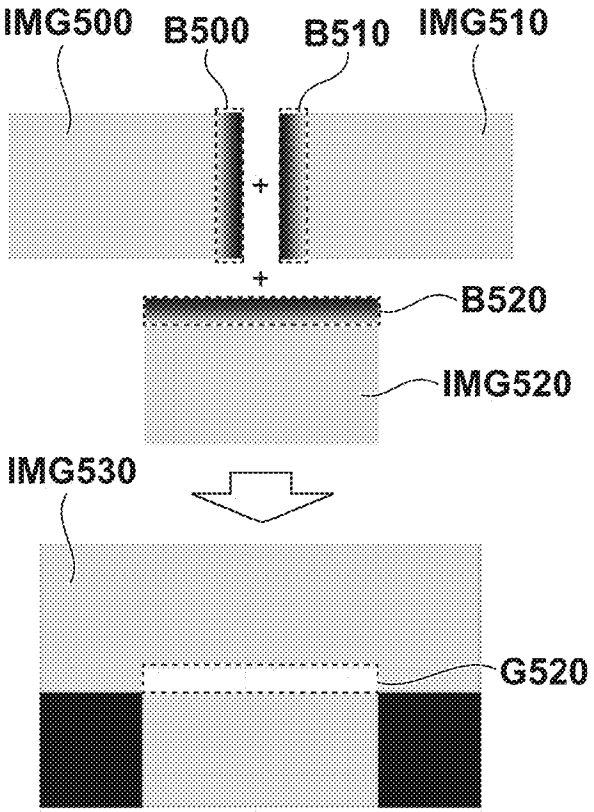

In view of this, the projection-type image display apparatus according to the fourth embodiment is configured to include both an LUT 302A and an LUT 302B as correction coefficient storage units (here, LUTs), as shown in FIG. 7. Here, the correction values included in the LUT 302A have been obtained with consideration given to the gamma characteristics with respect to the correction values shown in FIG. 2. With the correction values included in the LUT 302B, the luminance correction coefficients on one side in the vertical direction and on one side in the horizontal direction are 1, and the luminance correction coefficients gradually decrease to 0 toward the vertex at the position diagonally opposite to the vertex at which these sides intersect. In other words, consideration is given to the gamma characteristics with respect to the correction values shown in [T301+T311] in FIG. 6A to 6D.

With the present configuration, an example will be described in which a multi-screen display is configured by laying out, in an "L shape", three screens that are each 1920 pixels wide and 1200 pixels high at an overlap width of 300 pixels, similarly to embodiment 3. The methods for setting the overlapping regions and calculating the luminance correction coefficients T300, T310, and T320 to T322 are the same as those in the third embodiment.

The luminance correction coefficients T301 and T311 are calculated as correction coefficients obtained by multiplying the table in the LUT 302 and the vertical and horizontal inverse of the table in the LUT 302 respectively by the LUT 302B. The corrected luminances of the overlapping region corrected using T301, T311, and T322 are in a relationship in which they are 1 in the entire region upon adding the luminances in corresponding positions thereto.

As described above, in the present embodiment, correction is performed such that the luminance values on one side in the vertical direction and on one side in the horizontal direction in the overlapping region are 100%, and the luminance values gradually decrease to become 0% at the vertex diagonally opposite to the vertex at which the one side in the vertical direction and the one side in the horizontal direction intersect.

Accordingly, it is possible to provide a projection-type image display apparatus according to which uniformity in the composite luminance is maintained even if multi-screen display in the "L-shaped" layout is configured and the luminance correction coefficients are obtained with consideration given to the gamma characteristics.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Advantageous Effects of the Invention

According to the present invention, it is possible to provide a projection-type image display apparatus in which uniformity in the luminance of a screen is maintained even if multi-screen display in a free layout is configured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261833, filed Dec. 18, 2013, which is hereby incorporated by reference herein in its entirety.

What is claimed is:

1. An image processing apparatus comprising:

a specification unit configured to, from a first projection region for a first projection apparatus within a multi-screen display performed by a plurality of projection apparatuses, specify (a) a first overlapping region in which the first projection region for the first projection apparatus and a second projection region for a second projection apparatus overlap, (b) a second overlapping region in which the first projection region for the first projection apparatus and a third projection region for a third projection apparatus overlap, and (c) a third overlapping region in which (i) the first projection region for the first projection apparatus, (ii) the second projection region for the second projection apparatus, and (iii) the third projection region for the third projection apparatus overlap, wherein each overlapping region corresponds to a portion or a whole of one side of the first projection region;

a determination unit configured to, in accordance with overlap directions and positions of each of the first, second, and third overlapping regions in the multi-screen display, determine first luminance correction coefficients of the first overlapping region, second luminance correction coefficients of the second overlapping region, and third luminance correction coefficients of the third overlapping region, such that each of (a) a total luminance correction coefficient of the first luminance correction coefficients, (b) a total luminance correction coefficient of the second luminance correction coefficients, and (c) a total luminance correction coefficient of the third luminance correction coefficients becomes a predetermined value, wherein the total luminance correction coefficients are respectively obtained by adding luminance correction coefficients that are in a corresponding positional relationship in a respective one of the first, second, and third overlapping regions; and a correction unit configured to perform luminance correction processing for correcting luminance of image data for the multi-screen display, based on the first, second, and third luminance correction coefficients determined by the determination unit.

2. The image processing apparatus according to claim 1, wherein (a) among a plurality of line segments constituting the first, second, and third overlapping regions, the determination unit determines a luminance correction coefficient for a plurality of coordinates corresponding to a first line segment to be a first correction coordinate, and (b) among the plurality of line segments, the determination unit determines a luminance correction coefficient for a plurality of coordinates corresponding to a second line segment aligned parallel to the first line segment to be a second correction coefficient, and wherein the luminance correction coefficients corresponding to other coordinates in the overlapping region are set to be values from the first correction coefficient to the second correction coefficient.

3. The image processing apparatus according to claim 1, further comprising:

a storage unit configured to store an overlap pattern of projection regions in the multi-screen display and luminance correction coefficients in association with each other, wherein the determination unit specifies the overlap pattern based on a position of the first overlapping region in the first projection region and a position of the first overlapping region in the second projection region, determines the luminance correction coefficients corresponding to the specified overlapping pattern as correction coefficients for correction of image data, and reads them out from the storage unit.

4. The image processing apparatus according to claim 1, wherein a total value of a luminance correction coefficient corresponding to the first projection region and a luminance correction coefficient corresponding to the second projection region with respect to a pixel is 1.

5. The image processing apparatus according to claim 1, wherein the image processing apparatus is mounted in at least one of the plurality of projection apparatuses.

6. The image processing apparatus according to claim 1, wherein the determination unit determines the luminance correction coefficient such that the luminance correction coefficient at a coordinate corresponding to a first vertex in the overlapping region is 1 and a luminance correction coefficient at a coordinate corresponding to a second vertex located diagonally opposite to the first vertex in the overlapping region is 0.

7. The image processing apparatus according to claim 6, wherein the determination unit determines luminance correction coefficients corresponding to coordinates between first and second vertices in each of the first, second, and third overlapping regions to be values between 1 to 0.

8. The image processing apparatus according to claim 7, wherein the determination unit determines the luminance correction coefficients corresponding to coordinates between the first and second vertices such that the closer the corresponding coordinates are to the second vertex, the lower the correction coefficients are.

9. The image processing apparatus according to claim 1, further comprising a memory configured to store a predetermined coefficient table comprising luminance correction coefficients for a plurality of coordinates, wherein the determination unit selects, according to the overlap direction of each of the first, second, and third overlapping regions in the multi-screen display, the first, second, and third luminance correction coefficients from the predetermined coefficient table stored in the memory.

10. The image processing apparatus according to claim 1, wherein, in the second overlapping region, the first projection region for the first projection apparatus and the third projection region for the third projection apparatus overlap in either a left-oblique direction or a right-oblique direction, and wherein luminance correction coefficients for a screen-interior side of the second overlapping region are determined to be 1, luminance correction coefficients for a screen-exterior side of the second overlapping region are determined to be 0, and luminance correction coefficients for a third side of the second overlapping region, which is in contact with the third overlapping region, are determined to be values that gradually decrease from 1 to 0 from the screen-interior side to the screen-exterior side.

11. An image processing method comprising:

specifying, from a first projection region for a first projection apparatus within a multi-screen display performed by a plurality of projection apparatuses, (a) a first overlapping region in which the first projection region for the first projection apparatus and a second projection region for a second projection apparatus overlap, (b) a second overlapping region in which the first projection region for the first projection apparatus and a third projection region for a third projection apparatus overlap, and (c) a third overlapping region in which (i) the first projection region for the first projection apparatus, (ii) the second projection region for the second projection apparatus, and (iii) the third projection region for the third projection apparatus overlap, wherein each overlapping region corresponds to a portion or a whole of one side of the first projection region;

determining, in accordance with overlap directions and positions of each of the first, second, and third overlapping regions in the multi-screen display, first luminance correction coefficients of the first overlapping region, second luminance correction coefficients of the second overlapping region, and third luminance correction coefficients of the third overlapping region, such that each of (a) a total luminance correction coefficient of the first luminance correction coefficients, (b) a total luminance correction coefficient of the second luminance correction coefficients, and (c) a total luminance correction coefficient of the third luminance correction coefficients becomes a predetermined value, wherein the total luminance correction coefficients are respectively obtained by adding luminance correction coefficients that are in a corresponding positional relationship in a respective one of the first, second, and third overlapping regions; and performing luminance correction processing for correcting luminance of image data for the multi-screen display, based on the determined first, second, and third luminance correction coefficients.

12. The image processing method according to claim 11, wherein the determination step determines the luminance correction coefficient such that the luminance correction coefficient at a coordinate corresponding to a first vertex in the overlapping region is 1 and a luminance correction coefficient at a coordinate corresponding to a second vertex located diagonally opposite to the first vertex in the overlapping region is 0.

13. The image processing method according to claim 12, wherein, in the determining step, luminance correction coefficients corresponding to coordinates between first and second vertices in each of the first, second, and third overlapping regions are determined to be values between 1 to 0.

14. The image processing method according to claim 13, wherein in the determining step, the luminance correction coefficients corresponding to coordinates between the first and second vertices are determined such that the closer the corresponding coordinates are to the second vertex, the lower the correction coefficients.

15. A non-transitory computer-readable storage medium storing a computer-executable program, the program comprising:

a specification step of, from a first projection region for a first projection apparatus within a multi-screen display performed by a plurality of projection apparatuses, specifying (a) a first overlapping region in which the first projection region for the first projection apparatus and a second projection region for a second projection apparatus overlap, (b) a second overlapping region in which the first projection region for the first projection apparatus and a third projection region for a third projection apparatus overlap, and (c) a third overlapping region in which (i) the first projection region for the first projection apparatus, (ii) the second projection region for the second projection apparatus, and (iii) the third projection region for the third projection apparatus overlap, wherein each overlapping region corresponds to a portion or a whole of one side of the first projection region;

a determination step of, in accordance with overlap directions and positions of each of the first, second, and third overlapping regions in the multi-screen display, determining first luminance correction coefficients of the first overlapping region, second luminance correction coefficients of the second overlapping region, and third luminance correction coefficients of the third overlapping region, such that each of (a) a total luminance correction coefficient of the first luminance correction coefficients, (b) a total luminance correction coefficient of the second luminance correction coefficients, and (c) a total luminance correction coefficient of the third luminance correction coefficients becomes a predetermined value, wherein the total luminance correction coefficients are respectively obtained by adding luminance correction coefficients that are in a corresponding positional relationship in a respective one of the first, second, and third overlapping regions; and a correction step of performing luminance correction processing for correcting luminance of image data for the multi-screen display, based on the determined first, second, and third luminance correction coefficients.

16. The storage medium according to claim 15, wherein the determination step determines the luminance correction coefficient such that the luminance correction coefficient at a coordinate corresponding to a first vertex in the overlapping region is 1 and a luminance correction coefficient at a coordinate corresponding to a second vertex located diagonally opposite to the first vertex in the overlapping region is 0.

17. The storage medium according to claim 16, wherein, in the determination step, luminance correction coefficients corresponding to coordinates between first and second vertices in each of the first, second, and third overlapping regions are determined to be values between 1 to 0.

18. The storage medium according to claim 17, wherein in the determination step, the luminance correction coefficients corresponding to coordinates between the first and second vertices are determined such that the closer the corresponding coordinates are to the second vertex, the lower the correction coefficients are.

* * * * *